US006253472B1

(12) United States Patent
Gast

(10) Patent No.: US 6,253,472 B1
(45) Date of Patent: Jul. 3, 2001

(54) CLOSET MOUNTED IRONING BOARD

(76) Inventor: Arnold Gast, 268 Ladue Lake Dr., Chesterfield, MO (US) 63141

( * ) Notice: Subject to any disclaimer, the term of this patent is extended or adjusted under 35 U.S.C. 154(b) by 0 days.

(21) Appl. No.: 09/657,417

(22) Filed: Sep. 8, 2000

(51) Int. Cl.[7] ..... D06F 81/06
(52) U.S. Cl. ..... 38/137; 108/42
(58) Field of Search ..... 38/104, 137, 139; 108/39, 42, 47, 48

(56) References Cited

U.S. PATENT DOCUMENTS 1,671,881 * 5/1928 Barrie .
1,696,145 * 12/1928 Wagoner .
3,203,122 * 8/1965 Sweatt ..... 38/104
3,680,235 * 8/1972 Leemhuis ..... 38/104
4,862,811 9/1989 Davis .
4,909,158 3/1990 Sorensen .
4,961,388 10/1990 Simpson .
4,995,681 2/1991 Parnell .
5,452,531 9/1995 Graville et al. .
5,709,044 * 1/1998 Atapattu ..... 38/103
5,778,573 7/1998 Nottingham et al. .

* cited by examiner

*Primary Examiner*—Ismael Izaguirre
(74) *Attorney, Agent, or Firm*—Polster, Lieder, Woodruff & Lucchesi

(57) ABSTRACT

An ironing board center is mounted in a custom closet and occupies less than 10" of the closet. The ironing board center includes a pivot arm which is mounted to a side wall or divider of the closet, an extension arm journaled about the pivot arm and is movable axially and rotatably relative to the pivot arm, and an ironing board which is fixed to the extension arm. A pivot stop holds the pivot arm in a generally horizontal plane when the ironing board is pivoted down. A rotation stop prevents the ironing board from rotating relative to the pivot arm, and maintains the ironing board in a substantially horizontal position when the ironing board is lowered. An extension lock maintains the extension arm in the extended position. A spring clip engages the extension arm or pivot arm to hold the ironing board in its upright, storage position.

11 Claims, 5 Drawing Sheets

CLOSET MOUNTED IRONING BOARD

CROSS-REFERENCE TO RELATED APPLICATIONS

Not Applicable

STATEMENT REGARDING FEDERALLY SPONSORED RESEARCH OR DEVELOPMENT

Not Applicable.

BACKGROUND OF THE INVENTION

This invention relates to custom closets, and in particular to an ironing board center mountable in a custom closet.

Ironing boards are typically sold as stand alone units. These stand alone units must be stored someplace. Typically, they are stored in a closet. However, the ironing board is typically not stored in a convenient location, and can be difficult to get to.

To overcome this problem, ironing board were developed which are mounted on a wall, a cabinet, or a door, for example. However, in these systems, the ironing board is mounted flat (i.e., its working surface is parallel to the wall when in a stored position), so that it need only be pivoted down (or up) to be in a useable position. Because the boards are mounted with the board parallel to the wall (or door or cabinet) they take up a considerable amount of wall space.

BRIEF SUMMARY OF THE INVENTION

Briefly stated, an ironing board center of the present invention is mounted in a custom closet. The ironing board center is vary narrow, occupying less than 10" of closet space (and preferably about 6" of closet space) when the ironing board center is in an upright stored position.

The ironing board center includes a pivot arm which is mounted to a side wall or divider of the closet. The pivot arm is pivotal in a vertical plane about a pivot point. A rotation stop is mounted on the wall or divider to hold the pivot arm in a horizontal position when the pivot arm is pivoted downwardly. Preferably, the pivot stop includes a pair of stops—one in front of, and one behind, the pivot arm pivot point. The front pivot stop is below the pivot arm and the back stop is above the pivot arm.

An extension arm is journaled about the pivot arm and is movable axially and rotatably relative to the pivot arm. Lastly, an ironing board is fixed to the extension arm.

An extension stop is provided at the front of the pivot arm to limit the axial movement of the extension arm relative to the pivot arm and to prevent rotation of the extension arm about the pivot arm. The stop is preferably a pin at the front of the pivot arm which engages a slot at the end of the extension arm.

An extension lock is also provided to maintain the extension arm in its extended position. Preferably, the extension lock comprises a spring mounted finger in the pivot arm which is received in an opening in the extension arm. The extension lock can be combined with the extension stop.

A retraction stop is provided remote from the extension stop at a point forwardly of the pivot point. The retraction stop preferably includes a pin which receives an opening at the back of the extension arm. The retraction stop prevents the extension arm from hitting the nut which defines the rotation point of the pivot arm. Preferably, the retraction stop is off-set from the forward extension stop by about 90°.

A spring clip on the wall or divider engages the extension arm or pivot arm when the ironing board is in its upright position to maintain the ironing board in its upright storage position.

BRIEF DESCRIPTION OF THE SEVERAL VIEWS OF THE DRAWINGS

Corresponding reference numerals will be used throughout the several figures of the drawings.

DETAILED DESCRIPTION OF THE INVENTION

The following detailed description illustrates the invention by way of example and not by way of limitation. This description will clearly enable one skilled in the art to make and use the invention, and describes what I presently believe is the best mode of carrying out the invention.

Figure 3:
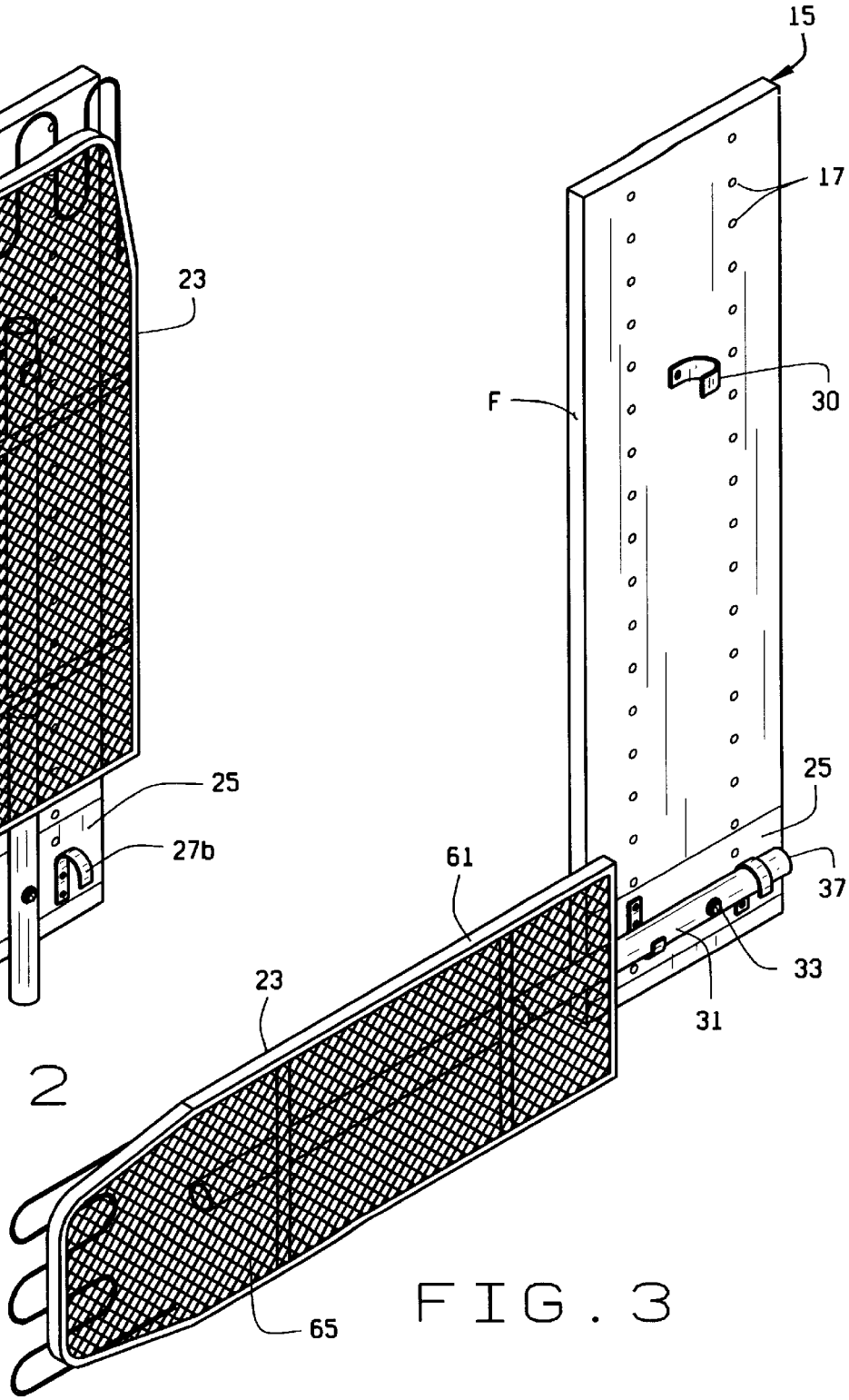
FIG. 3 is a perspective view of the ironing board pivoted down from the upright position.

A typical custom closet C in a bedroom, for example, can include a hanger section 1 having a pair of hanger bars 3 from which clothes can be hung, a section 5 with drawers 7 and shelves 9, and a section 11 having narrow shelves 13 such as for shoes, shirts, purses, etc. The sections 1, 5, and 11 all include dividers 15 which form the sides of the sections. The dividers 15 are fairly standard in the industry and extend out from a wall, such as a back wall of a reach-in closet. The dividers 15 include two vertically extending rows of holes 17, as seen in FIG. 3. The holes in each row are spaced apart a standard 32 mm, and each row is typically spaced from the edge of the divider 15 by 32 mm or 68 mm. The holes 17 accept fasteners for example to mount drawer slides and hangar bar brackets, as well as fingers on which the shelves 9 and 13 rest. As can be appreciated, the size, width, number, and arrangement of the different sections can be varied as needed by the particular installation. Additionally, other types of sections, such as a section with baskets, can also be added to the closet C.

Figure 1:
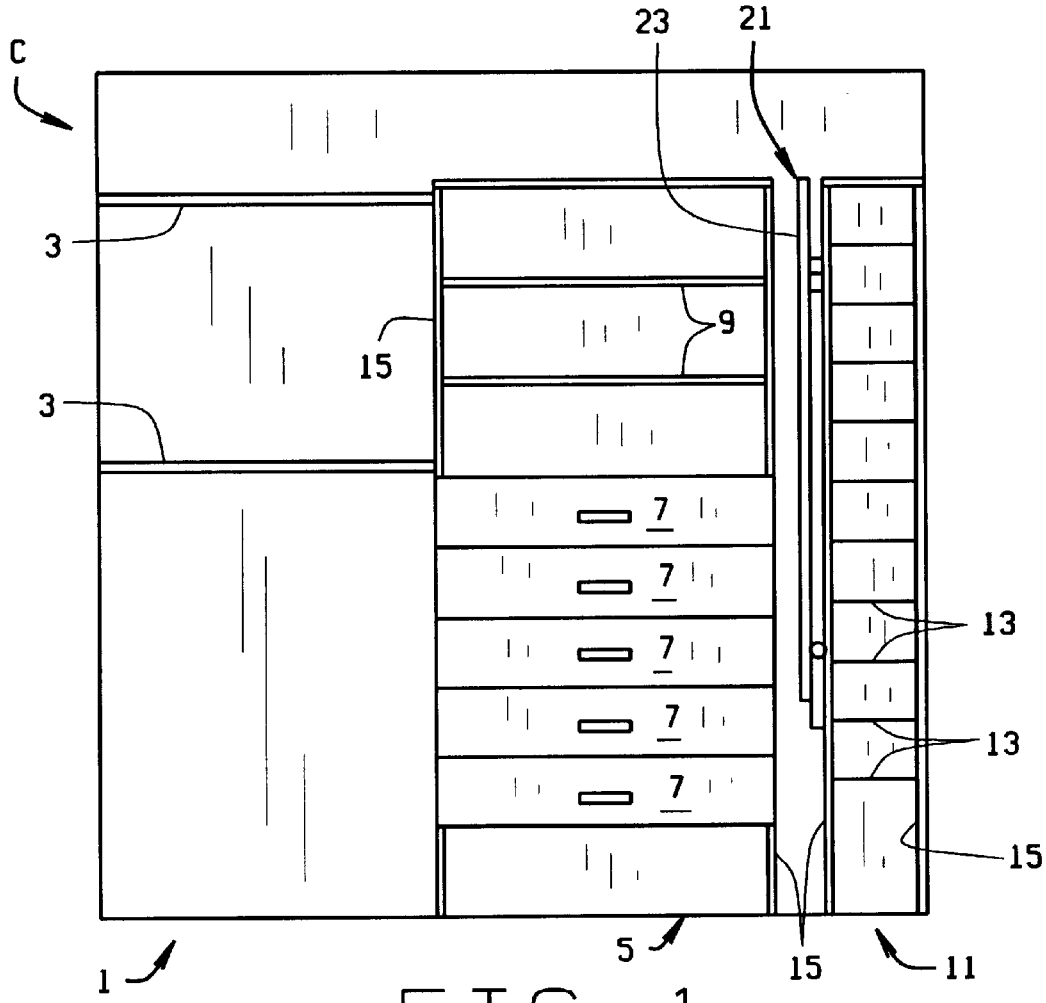
FIG. 1 is a front elevational view of a closet incorporation a closet mounted ironing board of the present invention.
Figure 6:
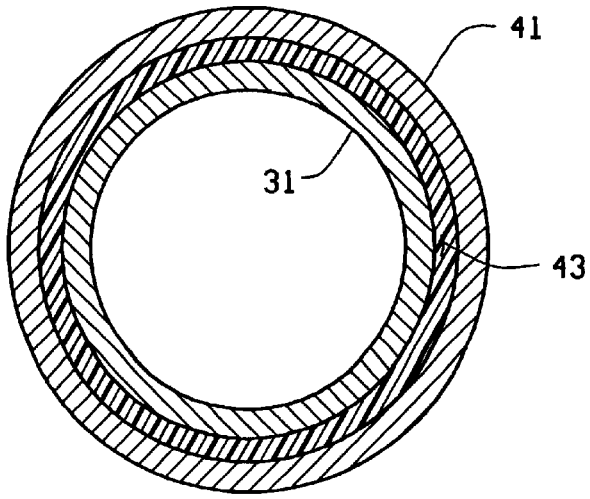
FIG. 6 is a cross-sectional view of the pivot and extension arms taken along line 6—6 of FIG. 5.
Figure 2:
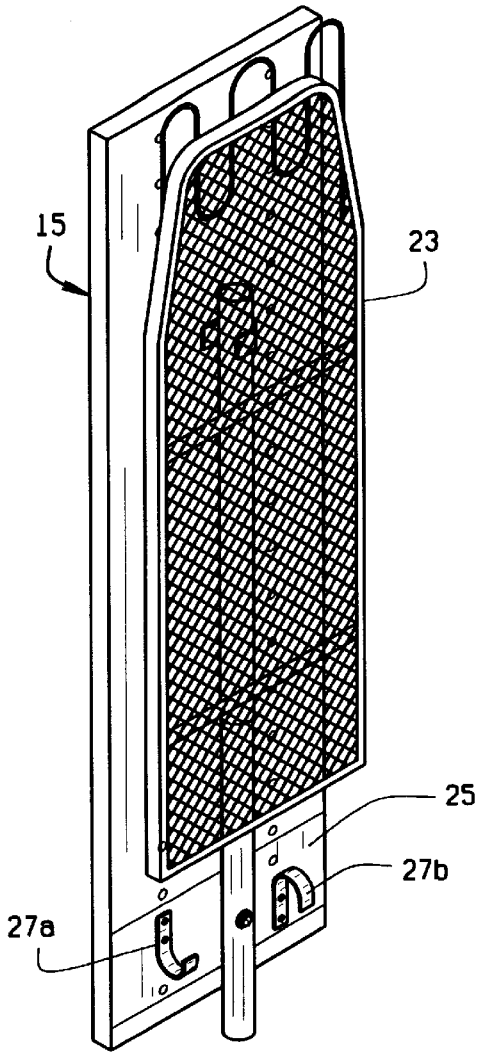
FIG. 2 is a perspective view of the ironing board in an upright, stored position, the ironing board being mounted to a closet divider.
Figure 4:
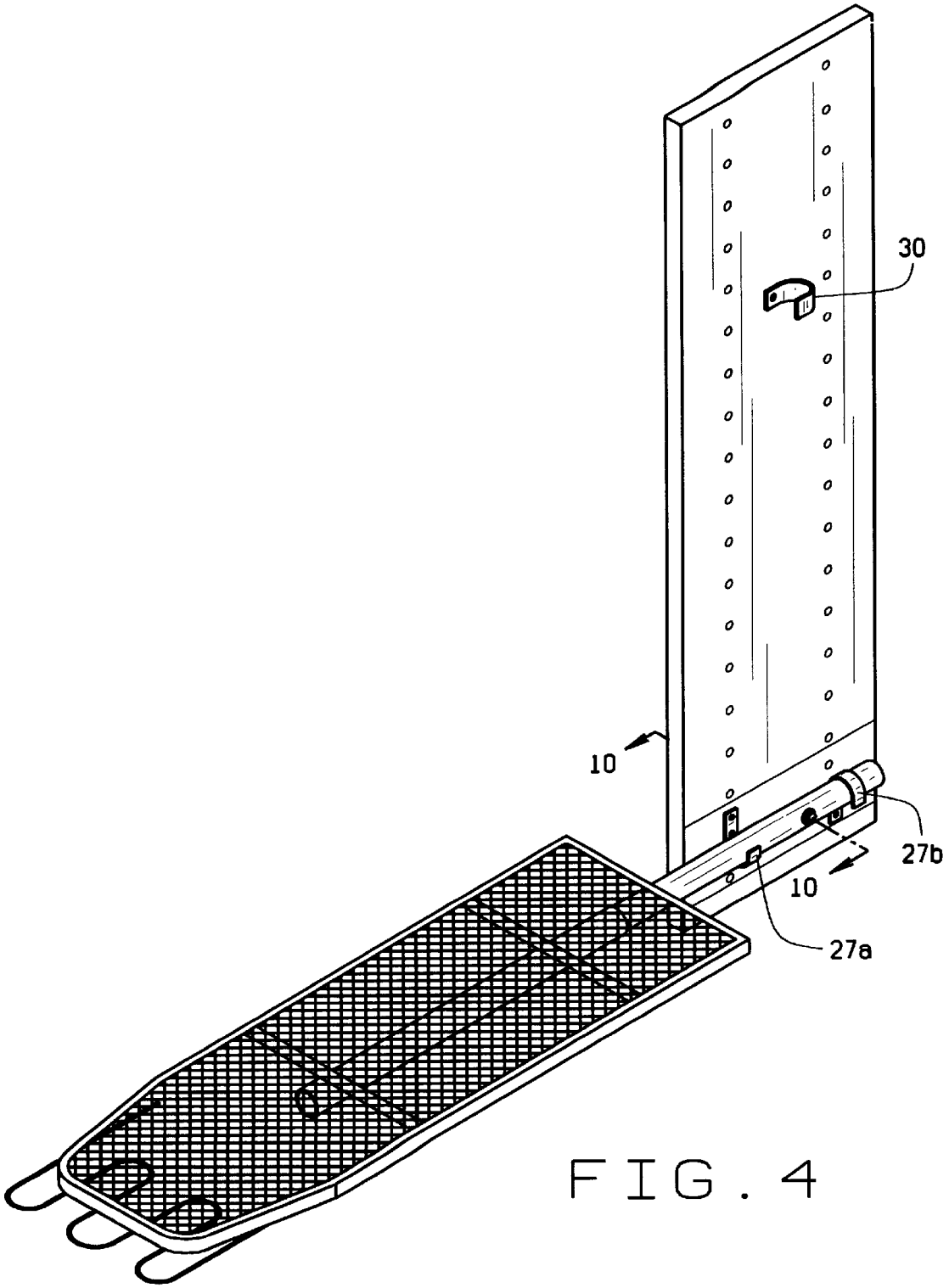
FIG. 4 is a perspective view of the ironing board in its working position ready for use.
Figure 5:
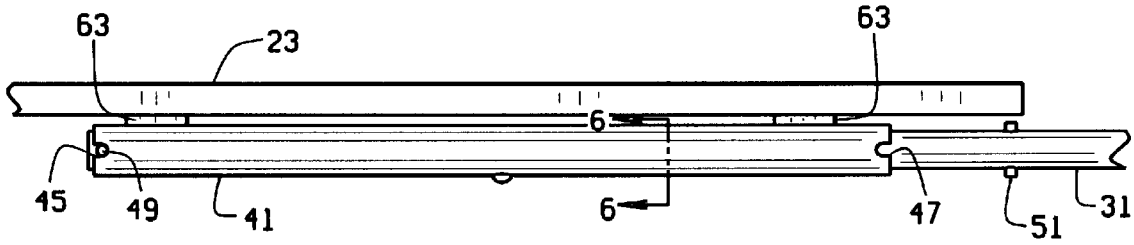
FIG. 5 is a fragmentary side elevational view of the ironing board and its associated pivot and extension arms.
Figure 7:
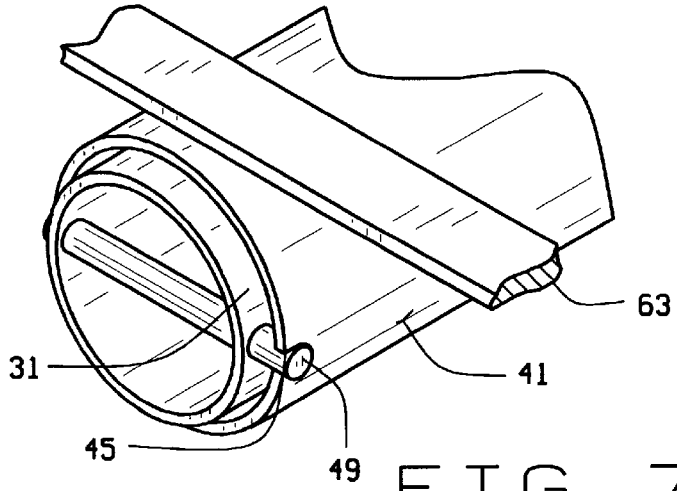
FIG. 7 is an end elevational view of an outer end of the pivot arm and extension arm showing a stop on the pivot arm which maintains the ironing board in a horizontal position during use.
Figure 8:
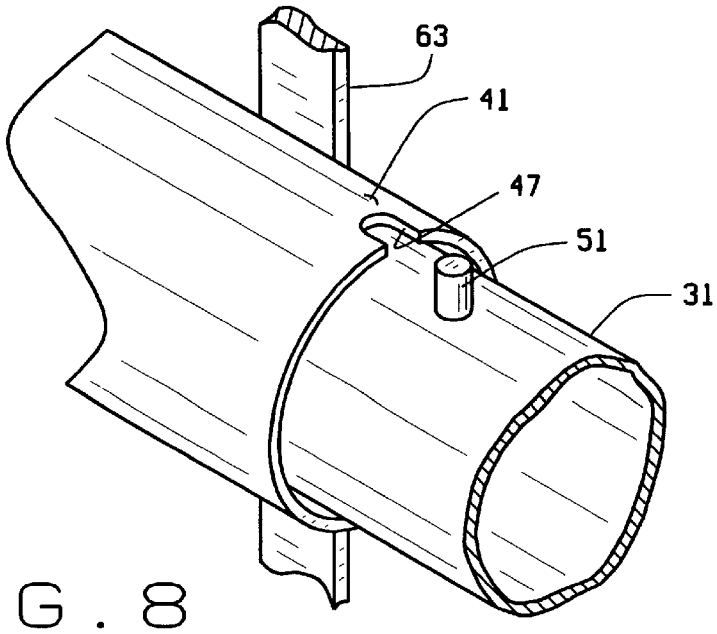
FIG. 8 is an end view of the opposite end of the pivot arm showing a stop which maintains the ironing board in a desired position when the board is in the upright position.

The closet C is also provided with an ironing board center 21. The ironing board center 21 is shown between the sections 5 and 11 of the closet C in FIG. 1, but could be positioned in any desired location in the closet. The ironing board center 21 includes an ironing board 23 which is mounted to a divider 15 and, as described below, is pivotable or rotatable about two axes to be moved between the upright and stored position, as seen in FIGS. 1 and 2, and a work position, as seen in FIG. 4. Importantly, the ironing board center is very narrow—it occupies less than 10" of closet space, and preferably, only about 6" of closet space. Thus, the ironing board center 21 can be incorporated into a custom closet with very little loss in the width of the other sections of the closet C.

To mount the ironing board 23 to the divider 15, the ironing board center 21 includes a mounting plate 25 which is fastened to the divider 15. The mounting plate has a pair of oppositely directed J-shaped hooks 27*a,b* which are fastened to the divider 15. Preferably, fasteners, such as screws extend through the legs of the hooks 27*a,b,* and through holes in the mounting plate 25 and into the preformed holes 17 in the divider 15. Thus, the fasteners not only hold the hooks 27*a,b* in place, but also fix the mounting plate 25 to the divider 15. The hook 27*a,* which is adjacent the forward edge of the divider is right side up (i.e., an upright J), and the hook 27*b,* which is adjacent the back edge of the divider is upside down (i.e., an inverted J). The hook portions of the hooks each define a radius, and the center of the radius for the two hooks are generally aligned with each other on a horizontal plane.

A spring clip 30 is mounted to the divider 15 above the plate 25. As will be described below, the clip 30 holds the ironing board 23 in its upright position.

A pivot arm 31 is pivotally mounted to the mounting plate 25. Preferably, An bolt 33 extends through the pivot arm 31 and is received in a nut 35 which is welded to the plate 25. Washers 32 are placed between the nut 35 and the pivot arm 31, and between the pivot arm 31 and the head of the bolt 33. The lower washer (between the nut and pivot arm) is preferably a plastic washer, and the upper washer (between the pivot arm and the bolt head) is preferably a steel washer. The pivot arm 31 could be mounted to the plate 25 in other manners as well. For example, the bolt could extend through the pivot arm 31 to be received in the plate 25 (and/or the divider 15). Instead of being received in a nut, the bolt 33 could be replaced with a pin which is received in a bearing, which in turn is fixed to the plate 25 or divider 15. The pivot arm 31 could rotate directly about this pin, or, the pivot arm could include bearings through which the pin is journaled to allow for smoother rotation of the arm 31 about the pin. No matter how the pivot arm 31 is mounted to the plate 25 (and divider 15), the pin 33 defines an axis of rotation for the pivot arm 31 relative to the divider 15. The pin 33 (and hence the axis of rotation for the arm 33) is spaced forwardly from the back end 37 of the pivot arm 31. As can be appreciated, the pivot arm 31 pivots in a vertical plane.

An extension arm 41 is journaled about the pivot arm 31 so that it may slide axially, and rotate, about the pivot arm 31. Thus, the pivot arm 31 defines the axis of rotation for the extension arm 41. To prevent the extension arm 41 from wobbling relative to the pivot arm 31, and to facilitate motion (both axial and rotational) of the extension arm 41 relative to the pivot arm 31, a plastic sleeve 43 is positioned between the two arms. The plastic sleeve 43 is preferably made from a plastic which has a relatively low coefficient of friction to allow the extension arm 41 to move easily and smoothly relative to the pivot arm 31.

The extension arm 41 is provided with a pair of slots 45 at its forward end and a pair of slots 47 at its back end. The slots 45 and 47 are at right angles to each other. The pivot arm 31 includes a pair of forward pins 49, and a pair of rearward pins 51. As with the extension arm slots, the pivot arm pins are positioned at right angles to each other. As will be explained below, the pivot arm pins 49 and 51 receive the cooperate with the extension arm slots 45 and 47, respectively to help maintain the ironing board 23 in its working and storage positions.

Figure 9:
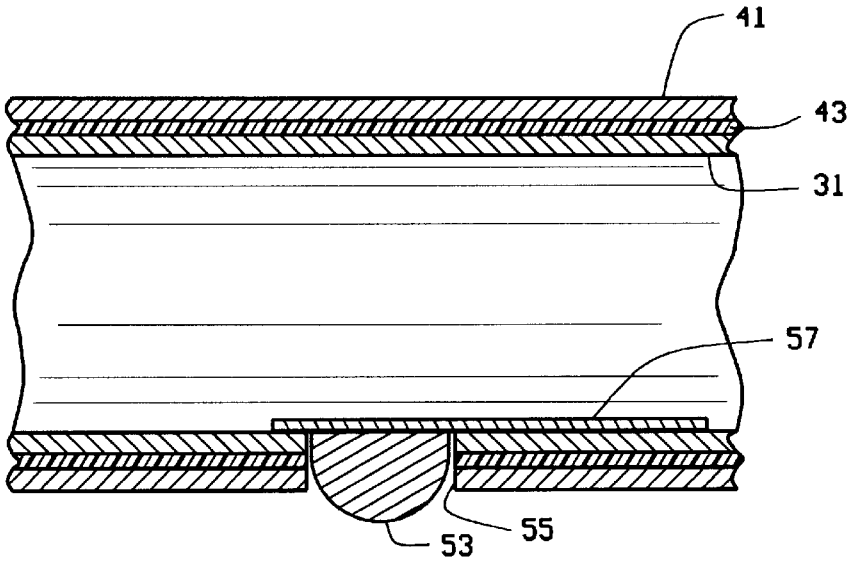
FIG. 9 is a cross-sectional view of the pivot arm showing a lock on the pivot arm which maintains the extension arm in its extended position.
Figure 10:
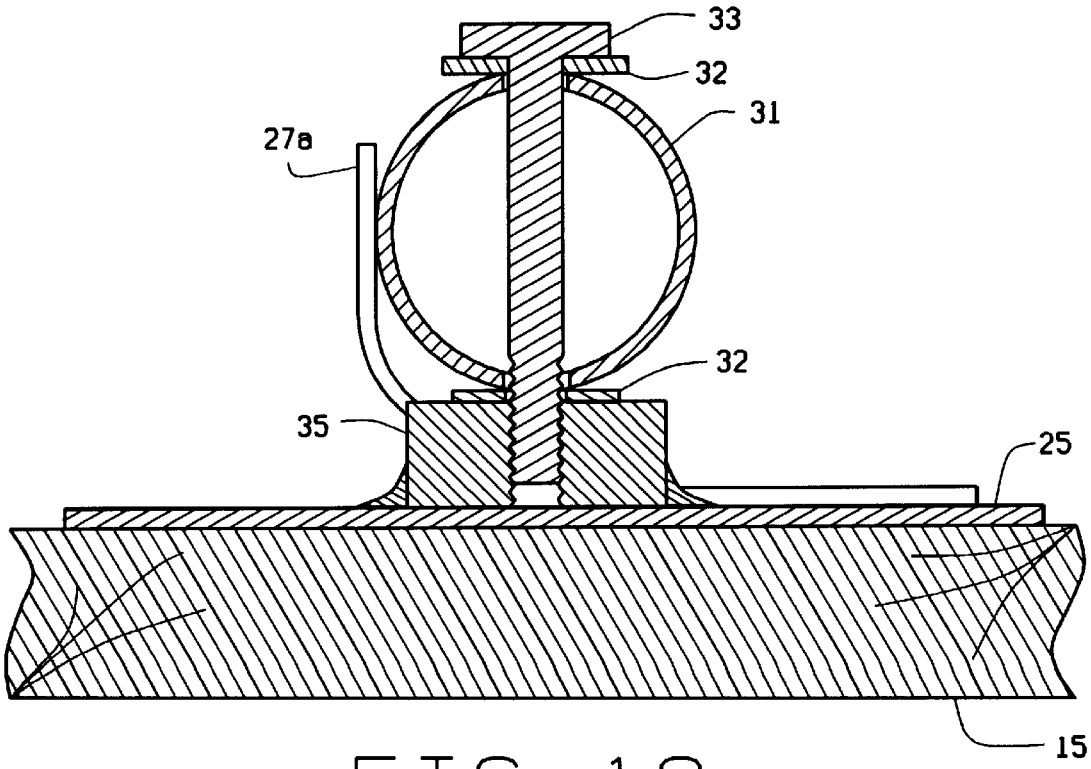
FIG. 10 is a cross-sectional view taken along line 10—10 of FIG. 4 showing the mounting of the pivot arm to a divider of the closet.

The pivot arm 31 is also provided with a spring biased finger 53 which engages an opening 55 in the extension arm. The pivot arm spring finger 53 is shown (in FIG. 9) to be mounted within the pivot tube 31 by a leaf spring 57, however, it could be mounted in other conventional ways. As will be explained below, the finger 53 engages the extension arm hole 55 when the arm 41 is extended to lock the arm 41 in its extended position.

The ironing board 23 is mounted to the extension arm 41. The ironing board includes a frame 61 and a pair of cross-braces 63 which are mounted to the bottom of the frame 61. A surface 65, such as a mesh surface, covers the top of the frame, and, is covered with an ironing cover, as is known. Although a mesh surface is shown, the surface 65 could be solid.

The ironing board 23 is stored in an upright position, as shown in FIGS. 1 and 2 with the surface 65 generally parallel to the divider 15. In this position, the spring clip 30 engages either the extension arm 41 or the pivot arm 31 to prevent pivot arm (and hence, the ironing board) from pivoting downwardly. The back slots 47 of the extension arm 41 engage the back pins 51 of the pivot arm. The back pins 51 are spaced forwardly of the nut 35, and prevent the extension arm 41 from damaging the nut 35 when the ironing board 23 is in the upright position.

To use the ironing board 23, the ironing board 23 is first pivoted downwardly, as seen in FIG. 2. In this position, the pivot arm 31 is engaged in the two J-hooks 27*a,b.* As can be seen, the J-hooks 27*a,b* maintain the pivot arm 31 horizontal when the arm 31 is pivoted downwardly.

At this point, the ironing board is still on its edge and the surface 65 is generally vertical. Thus, once the arm 31 is pivoted to its down position, the ironing board 23 is pulled forwardly and rotated 90° about the pivot arm so that the surface 65 will be generally horizontal. As the ironing board is rotated and pulled outwardly, the extension arm 41 is similarly rotated and pulled outwardly. The pins 49 will prevent the extension arm 41 from being pulled off the pivot arm 31. The pins 49 in the pivot arm 31 and the slots 45 in the extension arm 41 are positioned to maintain the ironing board surface 65 in a generally horizontal plane. Preferably, when the pivot arm 31 is pivoted to its lower, generally horizontal position, the pins 49 are generally horizontal (i.e., generally parallel to the ground or floor). Additionally, the extension arm hole 55 will become aligned with the lock finger 53 of the pivot arm and lock the extension arm 41 in its extended position. As can be appreciated, the engagement of the forward pivot arm pins 49 with the extension arm slots 45 and the engagement of the pivot arm finger 53 with the extension arm hole 55 maintains the ironing board on a horizontal plane. That is, the interaction of the finger 53 and hole 55, as well as the interaction between the pin 49 and slot 45 prevent the ironing board 23 from rotating about the pivot arm 31 when the ironing board is in its working position—i.e., the ironing board surface is in a horizontal plane parallel to the floor of a room. Although both the pin 45 and slot 49, and the finger 53 and hole 55 are provided, one could be removed without substantially affecting the operation of the ironing board.

To return the ironing board to its upright, storage position, the finger 53 is depressed so that it disengages the extension arm hole 55. The ironing board (and hence the extension arm 41) is pushed rearwardly along the pivot arm and rotated 90° about the pivot arm to be in a vertical plane, as in FIG. 3. The ironing board is pushed rearwardly until the extension arm slots 47 engage the back pins 51. At this point (or before) the board 23 can be rotated so that the extension arm slots 49 engage the pins 51. The board 23 (and hence the arms 31 and 41) are pivoted upwardly until they are grasped by the spring clip 30. As can be appreciated, the interaction of the pins 51 with the slots 47 prevent the ironing board from rotating about the pivot arm 31 while in the upright and stored position.

The provision of the hooks 27*a,b,* the pin 49 and slot 45, and the finger 53 and hole 55 maintain the ironing board in a level position during use. Thus, the ironing board does not need a front support leg or other aids to maintain the board horizontal when in its working position, as seen in FIG. 4. As can be appreciated, the extension arm 41 is shorter than the pivot arm. The pivot arm 41 is sized, such that when the ironing board is pivoted and rotated to its operating position, as shown in FIG. 3, the back of the ironing board 23 will be forward of the divider 15 so that the full length of the ironing board can be used. For a typical reach in closet, which may have a depth of 2 feet, the pivot point is approximately one foot from the front of the closet, and the pivot arm has a length of about 44".

As various changes could be made in the above constructions without departing from the scope of the invention, it is intended that all matter contained in the above description or shown in the accompanying drawings shall be interpreted as illustrative and not in a limiting sense. Although the hooks 27*a,b* are mounted to the mounting plate 25, they could alternatively be mounted directly to the divider 15. The hooks 27*a,b* could be replaced with simple stops. However, a simple stop would not prevent lateral movement of the pivot arm which is prevented by the J-hooks. Although the ironing board center is shown mounted to a divider for the closet C, it could also be mounted to a side wall of the closet C. One of the two J-hooks 27*a,b* could be eliminated, as long as the remaining J-hook (or stop) were sufficiently strong to support the ironing board in its working position. The pins 49 could be replaced with spring mounted fingers and the slots 45 could be replaced with holes. These spring mounted fingers then would both prevent unwanted rotation of the ironing board to maintain the ironing board level and lock the extension arm in the extended position. This would thus allow for removal of the finger 53 and hole 55. These examples are merely illustrative.

What is claimed is:

1. An ironing board center mountable in a closet, the closet including a vertical surface defining either a side to said closet or a side to a section of said closet; the ironing board center including:

a pivot arm having a forward end and a back end and being operatively mounted to said vertical surface; said pivot arm being pivotal in a vertical plane about a pivot point between a raised position and a lowered position; said pivot point being forward of the back end of pivot arm;

front and back pivot stops on said vertical surface positioned on opposite sides of said pivot point; said stops being positioned such that when said pivot arm is in said lowered position, said front stop is below said pivot arm, said back stop is above said pivot arm, and said pivot arm is substantially horizontal;

an extension arm journaled about said pivot arm; said extension arm being slideable axially and rotationally relative to said pivot arm; and an ironing board mounted on said extension arm, said ironing board being movable about two axes between a stored position in which said ironing board is substantially parallel to said vertical surface and a working position in which said ironing board is substantially horizontal.

2. The ironing board center of claim 1 wherein said pivot arm includes an extension stop and said extension arm including an opening; said pivot arm stop engaging said extension arm opening to prevent said ironing board from rotating about said pivot arm when said ironing board is in said working position.

3. The ironing board center of claim 1 wherein said pivot arm stop is a pin extending radially from said pivot bar and/or a spring mounted finger.

4. The ironing board center of claim 1 wherein, said extension stop is a pin and said opening comprises a slot at a forward end of said extension bar.

5. The ironing board center of claim 1 including a back retraction stop on said pivot bar; said back retraction stop being spaced forwardly of said pivot point; said extension bar engaging said back retraction stop when said ironing board is in said upright position.

6. The ironing board center of claim 5 wherein said back retraction stop engages a back end of said extension arm to prevent rotation of said ironing board relative to said pivot arm when in said stored position.

7. The ironing board center of claim 5 wherein said back retraction stop is off-set from said forward extension stop by about 90°.

8. The ironing board center of claim 1 including a spring clip mounted to said vertical surface; said spring clip engaging one of said extension arm and pivot arm when said ironing board is in its upright position to maintain said ironing board in said upright position.

9. An ironing board center mountable in a closet, the closet including a vertical surface defining either a side to said closet or a side to a section of said closet; the ironing board center including:

a pivot arm mountable to the vertical surface and having a forward end and a back end; said pivot arm being pivotal in a first plane about a pivot point between a raised position and a lowered position; said pivot point being forward of the back end of pivot arm;

an extension arm on said pivot arm, said extension arm being movable laterally and rotationally relative to said pivot arm;

an ironing board fixedly mounted to said extension arm, said ironing board being movable axially and rotationally relative to said pivot arm;

a pivot stop which engages said pivot arm when said pivot arm is pivoted downwardly to maintain said pivot arm in a substantially horizontal plane; and a rotation stop, said rotation stop maintaining said ironing board in a substantially horizontal position.

10. The ironing board center of claim 9 wherein said pivot stop comprises a pin on said pivot arm and an opening on said extension arm; said pivot arm pin engaging said extension arm opening to prevent rotation of said extension arm and said ironing board about said pivot arm.

11. The ironing board center of claim 9 wherein the ironing board center, when in an upright, stored position, has a side-to-side width of less than 10 inches.

* * * * *